US007417365B2

(12) United States Patent
Nakamura et al.

(10) Patent No.: US 7,417,365 B2
(45) Date of Patent: Aug. 26, 2008

(54) IMAGE DISPLAY DEVICE HAVING ELECTRICAL LEAD CONNECTIONS FIXED THROUGH A PORTION OF AN EXHAUSTING PIPE BODY

(75) Inventors: Tomoki Nakamura, Mobara (JP); Kazunari Noguchi, Mobara (JP); Yoshiyuki Kaneko, Mobara (JP)

(73) Assignee: Hitachi Displays, Ltd., Mobara-shi (JP)

( * ) Notice: Subject to any disclaimer, the term of this patent is extended or adjusted under 35 U.S.C. 154(b) by 447 days.

(21) Appl. No.: 11/051,025

(22) Filed: Feb. 7, 2005

(65) Prior Publication Data

US 2005/0206299 A1 Sep. 22, 2005

(30) Foreign Application Priority Data

Feb. 9, 2004 (JP) ..... 2004-032354

(51) Int. Cl.
*H01J 61/62* (2006.01)
*H01J 63/04* (2006.01)

(52) U.S. Cl. ..... 313/495; 313/496; 220/2.1 R; 220/2.2

(58) Field of Classification Search ..... 313/495–497; 220/2.1 R, 2.2
See application file for complete search history.

(56) References Cited

U.S. PATENT DOCUMENTS 5,519,284 A * 5/1996 Pepi ..... 313/495
5,965,978 A 10/1999 Kishino et al.
6,114,804 A 9/2000 Kawase et al.
6,476,547 B1 11/2002 Kawase
6,541,912 B1 4/2003 Fritz et al.
6,603,255 B2 8/2003 Takahashi
2002/0021081 A1 2/2002 Tajima

FOREIGN PATENT DOCUMENTS

| | | |
|---|---|---|
| JP | 10-31433 | 2/1998 |
| JP | 10-326581 | 12/1998 |
| JP | 11-317182 | 1/1999 |
| JP | 2000-260359 | 9/2000 |
| JP | 2000-311636 | 11/2000 |
| JP | 2003-92075 | 3/2003 |

* cited by examiner

*Primary Examiner*—Mariceli Santiago
(74) *Attorney, Agent, or Firm*—Antonelli, Terry, Stout & Kraus, LLP.

(57) ABSTRACT

In a corner portion outside a display region of a face substrate which constitutes a face panel of a display device, an opening is formed. In the opening, a stem glass structural body which is configured by integrally forming an exhaust pipe on a center portion of a stem glass and by forming conductive leads in a peripheral portion thereof in an embedded manner, is fixed by welding using curing by heating. The exhaust pipe is evacuated and, thereafter, tipped off, thus realizing vacuum sealing of the inside thereof. A lead line is connected to a distal end of one conductive lead by welding and another end of the lead line is electrically connected with one end portion of the anode formed on an inner surface of the face substrate using a conductive adhesive agent. Further, a getter is mounted and fixed to another conductive lead line by welding.

5 Claims, 8 Drawing Sheets

IMAGE DISPLAY DEVICE HAVING ELECTRICAL LEAD CONNECTIONS FIXED THROUGH A PORTION OF AN EXHAUSTING PIPE BODY

BACKGROUND OF THE INVENTION

The present invention relates in general to an image display device of the type which includes electron beam sources having electron sources (cathodes) which emit electrons and phosphors, which are excited upon radiation by electron beams that are emitted from the electron sources toward anodes; and, more particularly, the invention relates to an image display device of the type described, which includes an improved voltage supply means that supplies a high voltage to the anodes.

As a display device which exhibits a high brightness and high definition, color cathode ray tubes have been widely used for many years. However, along with the recent desire for images of higher quality in information processing equipment or television broadcasting, the demand for planar displays (panel displays) which are light in weight and require a small space, while exhibiting high brightness and high definition, has been increasing. As typical examples, liquid crystal display devices, plasma display devices and the like have been put into practice.

More, particularly, as display devices which can realize a higher brightness, it is expected that various kinds of panel-type display devices, including a display device which utilizes an emission of electrons from electron sources into a vacuum, referred to as "an electron emission type display device", or "a field emission type display device", and an organic EL display, which is characterized by low power consumption will be commercialized.

Among such panel type display devices, such as the above-mentioned field emission type display device, particularly, a display device having an electron emission structure which was invented by C. A. Spindt et al, a display device having an electron emission structure of a metal-insulator-metal (MIM) type, a display device having an electron emission structure which utilizes an electron emission phenomenon based on a quantum theory tunneling effect (also referred to as a "surface conduction type electron source), and a display device which utilizes an electron emission phenomenon having a diamond film, a graphite film or carbon nanotubes have been proposed.

Among such panel type display devices, the field emission type display device, as shown in FIG. 9 herein, which is a developed perspective view, is constituted such that spacers SPC, which are arranged at given intervals, and a sealing frame MFL are interposed between a face panel PN2, which includes an anode and a phosphor on an inner surface thereof, and a back panel PN1 which has field emission type cathodes and control electrodes formed therein; and, these panels have portions thereof disposed around the display region that are laminated to each other and sealed to each other at the sealing frame MFL. Thereafter, the pressure inside a sealed space defined between the two panels is reduced by evacuating to a level that is lower than ambient pressure or is maintained in a vacuum condition. Then, electron beams which are emitted from the cathodes, while a high voltage is supplied to the anode, are accelerated by control electrodes MG, thus efficiently causing a phosphor screen to emit light.

In a field emission type display device having such a constitution, to supply a high voltage to the anode, as shown in FIG. 10(*a*) and FIG. 10(*b*), a method has been adopted in which a portion of the anode ADE is extended out to an end portion of the face panel PN2 in the same pattern and, at the same time, projects to the outside of the sealing frame MFL, thus forming an anode terminal ADE-T. Here, the illustration of various types of electrodes and the like, which are formed on the back panel PN1, has been omitted in the drawing.

According to such a constitution, although an electrical connection which serves to supply a the high voltage to the anode terminal ADE-T from the outside is ensured, the constitution requires a structure in which the anode-terminal ADE-T is exposed to the atmosphere, and, hence, it is difficult to ensure the desired dielectric strength property thereof. Further, the adhesion and fixing of the sealing frame MFL and the face panel PN2, on which the anode ADE is formed, are performed using a low-melting-point glass material (frit glass) or the like, and, hence, it is difficult to also ensure the desired dielectric strength characteristics.

Further, as another voltage supply means, for example, Japanese Laid-open patent publication Hei10(1998)-31433 discloses a field emission type display device having the following connection means. That is, an anode lead which has one end thereof connected by pressing to an anode terminal of the anode formed on an inner surface of the face panel has the other end thereof pulled out to the outside after hermetically penetrating a getter chamber. Further, in Japanese Laid-open patent publication Hei10(1998)-326581 discloses a field emission type display device having the following constitution. That is, an anode lead which has one end thereof connected to a lead line of an anode, which is formed on an inner surface of the face panel, has the other end thereof pulled out to the outside after being allowed to hermetically pass through a back panel.

Further, Japanese Laid-open patent publication 2000-260359 and Japanese Laid-open patent publication 2003-92075 disclose a field emission type display device having the following constitution. That is, an anode lead, which has one end thereof connected to an anode terminal of the anode formed on an inner surface of the face panel, is pulled out to the outside after being allowed to pass through the inside of a through opening formed in a back panel, which through opening is formed at a corner thereof by way of an insulating member. Further, Japanese Laid-open patent publication 2000-311636 discloses a field emission type display device having the following constitution. That is, an anode lead, which has one end thereof connected to an anode terminal of the anode formed on an inner surface of the face panel, is pulled out to the outside after being allowed to pass through the inside of an insulating body, which is formed in a through hole of the back panel.

SUMMARY OF THE INVENTION

As a high voltage supply means to the anode, for example, usually, the following structure is considered. That is, an anode button structure is formed on the back panel in the same manner as the anode button structure that is formed on a funnel portion of a cathode ray tube, and a high voltage is supplied to the anode from the anode button structure. However, the mounting of the anode button structure on an ordinary sheet of glass, which constitutes a back panel, is technically extremely difficult; and, hence, the back panel adopts a formed glass structure having an anode button, thus giving rise to a drawback in that the cost of the vacuum envelope (the face panel and the back panel) is increased.

Accordingly, the present invention has been made to overcome the above-mentioned drawbacks and to provide an image display device which can realize a vacuum envelope at a low cost by forming the high voltage connection simply and easily, whereby the manufacturing cost can be reduced.

Further, it is another object of the present invention to provide an image display device in which the dielectric strength characteristics of an anode electrode lead peripheral portion, to which a high voltage is supplied, are enhanced.

To achieve these objects, the image display device according to the present invention includes a face substrate having an anode and phosphors on an inner surface thereof, a back substrate which has electron sources on an inner surface thereof and is arranged to face the face substrate with a given distance therebetween, and a sealing frame which is interposed between the face substrate and the back substrate, while surrounding a display region which is formed at center portions of opposingly facing surfaces of the main surfaces of the face substrate and the back substrate, so as to hold the face substrate and the back substrate at the given distance, and end surfaces of the sealing frame and the face substrate and the back substrate are respectively hermetically sealed by way of a sealing material, thus forming a vacuum envelope. In this image display device, an exhaust pipe is formed in at least one portion of the vacuum envelope, and a stem glass structural body, in which at least one conductive lead, which constitutes an electrical connection in the inside of the vacuum envelope and penetrates therethrough hermetically, is hermetically bonded to a peripheral portion of the exhaust pipe, whereby a high voltage connection from the outside to the inside of the vacuum envelope can be realized with a simple and easy to manufacture structure.

In the above-mentioned constitution, by hermetically joining the stem glass structural body to any one of the face substrate, the back substrate and the sealing frame, which constitute the vacuum envelope, it is possible in accordance with the present invention to realize the conductive connection with a simple and easy to manufacture structure, so that the above-mentioned drawbacks can be overcome.

In the above-mentioned constitution, by allowing one of the conductive leads to be electrically connected with the anode, a high voltage is introduced to the anode formed on the inner surface of the face substrate from the outside, and, hence, it is possible in accordance with the present invention to overcome the above-mentioned drawbacks.

Here, it is needless to say that the present invention is not limited to the above-mentioned constitutions and the embodiments to be described later, and that various modifications can be made without departing from the technical concept of the present invention.

According to the present invention, a stem glass structural body, in which at least one conductive lead, which supplies a voltage from the outside, is embedded in the stem glass, and an exhaust pipe, which I used to evacuate the inside of the envelope and is integrally formed on a center portion thereof, are hermetically joined to at least one portion of the vacuum envelope; and, hence, it is possible to realize a conductive connection having a high dielectric strength property with a simple structure that is easy to manufacture, whereby the vacuum envelope can be realized at a low cost, thus giving rise to an excellent advantageous effect in that the manufacturing cost can be reduced.

Further, according to the present invention, by choosing any one of the face substrate, the back substrate and the sealing frame as the envelope portion to which the stem glass structural body is hermetically joined, it is possible to realize a conductive connection having a simple and easy to manufacture structure, and, hence, the vacuum envelope can be realized at a low cost, thus giving rise to an excellent advantageous effect in that the manufacturing cost can be reduced.

Further, according to the present invention, it is possible to enhance the dielectric strength property of the anode lead peripheral portion to which a high voltage is supplied, and, hence, it is possible to obtain an extremely advantageous effect in that an image display device which exhibits high quality and high reliability can be realized.

DESCRIPTION OF THE PREFERRED EMBODIMENTS

Specific embodiments of the present invention will be explained in detail in conjunction with the drawings.

Embodiment 1

Figure 1:
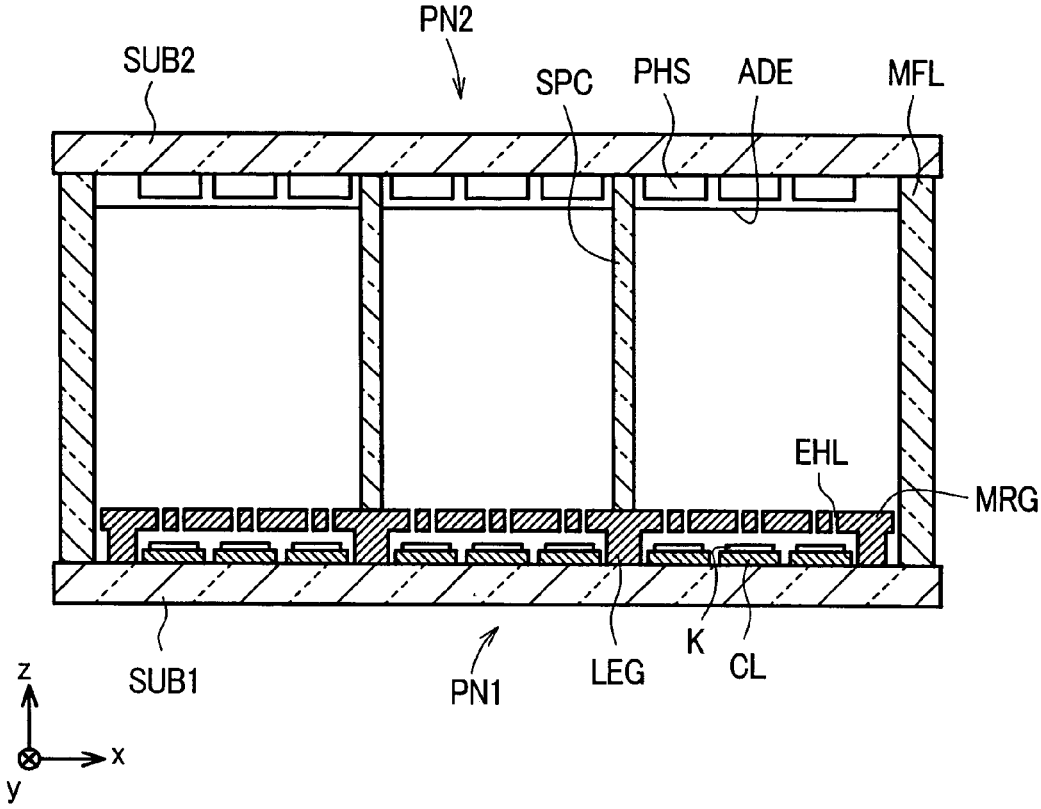
FIG. 1 is a cross-sectional view showing a representative part of the constitution according to an embodiment 1 of an image display device according to the present invention.

FIG. 1 is a cross-sectional view showing an embodiment 1 of an image display device of the present invention. In FIG. 1, SUB1 is a back substrate, which is formed as an insulating substrate, such as a glass plate, and it constitutes a back panel PN1. On an inner surface of the back substrate SUB1, a plurality of cathode lines CL are formed, which extend in one direction y (the horizontal direction) and are arranged in parallel in another direction x (vertical direction), and they include electron sources K, which use CNT (carbon nanotubes. Further, on the back panel PN1, control electrodes are arranged in the following manner. That is, a plurality of control electrode elements MRG, which cross the cathode lines CL in a non-contact manner, extend in the x direction and are arranged in parallel in the y direction, whereby pixels are formed at crossing portions with the cathode lines CL, and they have electron passing holes EHL, which allow electrons from the electron sources K to pass therethrough to the face panel PN2 side.

In the control electrode elements MRG, the electron passing holes EHL are formed in an iron-based thin wall web portion using a photolithography method or the like; and, at the same time, legs LEG, which project to the back substrate SUB1 side are formed on the iron-based thin wall portion. The leg portions LEG are brought into contact with the back substrate SUB1 between the respective cathode lines CL and are fixed by a method to be described later.

On the other hand, the face panel PN2 is laminated to the back panel PN1 so as to provide a given distance therebetween in the z direction. The face panel PN2 is constituted by forming phosphors PHS thereon, which are divided by a black matrix film (not shown), and an anode ADE, made of a transparent high-conductive thin film or the like, covers the phosphors PHS on an inner surface of the face substrate SUB2, which is formed a light permeable insulating substrate, such as a glass plate. The back panel PN1 and the face panel PN2 are joined together and sealed by a sealing frame MFL, which surrounds the laminated end peripheries of the back panel PN1 and the face panel PN2 and is arranged between the back panel PN1 and the face panel PN2. The sealed inside space is held in a vacuum state, thus constituting a vacuum envelope.

On the display region defined between the sealed face panel PN2 and the back panel PN1, spacers SPC are provided so as to maintain a given distance between both substrates. These spacers SPC are formed of a thin insulating plate, such as a glass sheet or the like. In this embodiment, the spacers SPC are arranged at an interval of every three cathode lines. However, the positions where the spacers SPC are mounted and the interval number corresponding to the cathode lines are optimally designed in view of the screen size, and the resolution of the image display device.

In the image display device having such a constitution, a given potential difference is applied between the cathode lines CL, the control electrodes G and the anode ADE. Electrons which are emitted from the electron sources formed on the cathode lines CL pass through the electron passing holes EHL formed in the control electrodes G, and, they are directed to the anode ADE and excite the phosphors PHS, so that light is emitted from the phosphors PHS with a given wavelength. The pixels are arranged two-dimensionally, thus forming the display region on the face panel PN2 where an image is displayed.

Figure 2:
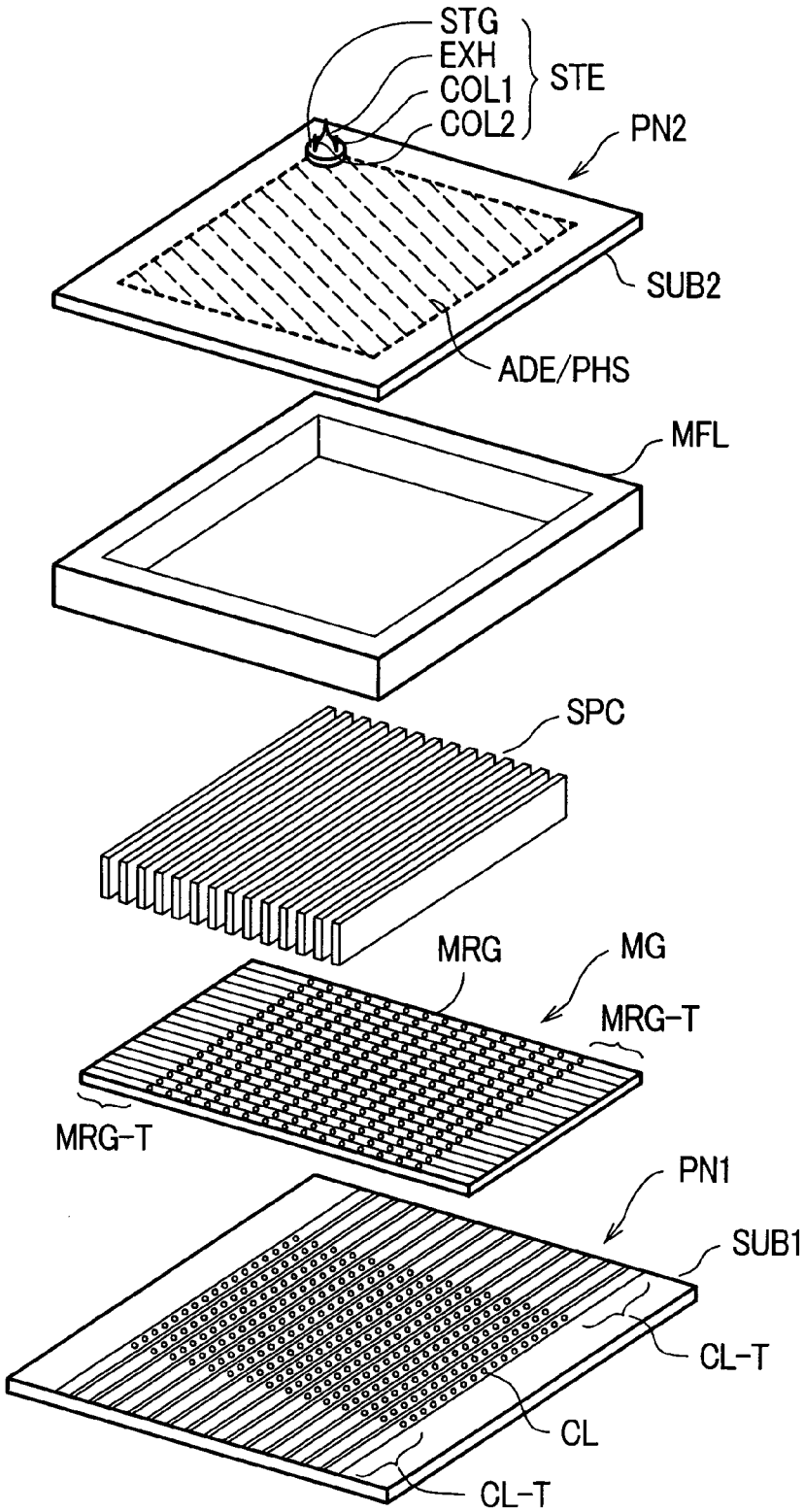
FIG. 2 is a developed perspective view schematically showing the mechanical constitution of the image display device shown in FIG. 1.

FIG. 2 is developed perspective view showing the image display device of FIG. 1, wherein the same symbols are used in FIG. 2 to identify parts identical with the parts shown in FIG. 1. In FIG. 2, from the cathode lines CL, which are formed on the inner surface of the back panel PN1, terminals are pulled out to an end portion of the back substrate SUB1, which constitutes the back panel PN1, as the cathode lines CL per se, or separately from the cathode lines CL, thus forming the cathode pull-out terminals CL-T. Further, control electrode elements MRG, which are insulated from the cathode lines CL and constitute the control electrodes MG that are fixed to the back substrate SUB1, also extend to an end portion of the back substrate SUB1, which constitutes the back panel PN1, thus forming the control electrode element pull-out terminals MRG-T.

Figure 3:
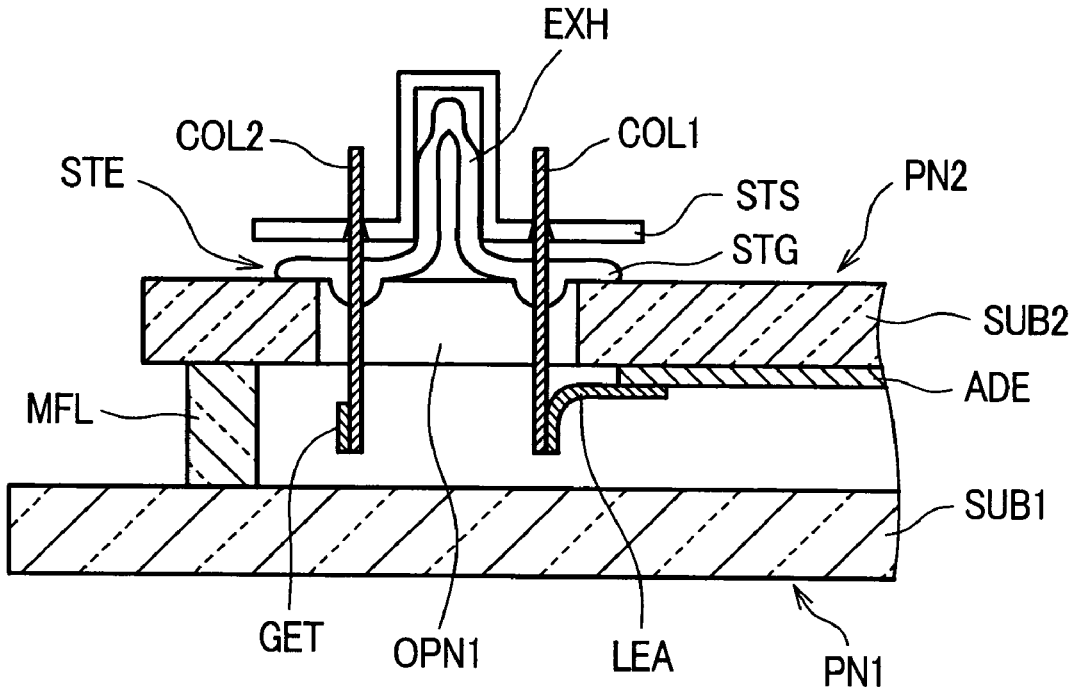
FIG. 3 is an enlarged cross-sectional view showing the stem glass structural body formed in the image display device shown in FIG. 2.

Further, at a corner portion of the face substrate SUB2, which constitutes the face panel PN2, in an area outside the display region, an opening OPN1 is formed, as shown in FIG. 3. In the opening OPN1, an exhaust pipe EXH is integrally formed at the center thereof. Further, a stem glass structural body STE, which is configured such that two conductive leads COL1, COL2, which are formed by joining inner leads and stem pins using dumet lines, are formed such that the two conductive leads COL1, COL2 are embedded in the stem glass STG, are hermetically joined to a peripheral portion of the opening OPN1 by welding using curing by heating by interposing frit glass, for example.

Here, the stem glass structural body STE is configured to have the substantially the same structure as a CRT stem glass structural body which is mounted on a neck portion of a cathode ray tube, for example. Further, the exhaust tube EXH, which is integrally formed with the stem glass structural body STE, is tipped off after the inside of the vacuum envelope is evacuated in a final step, and, hence, the inside of the container is sealed in a vacuum state. Further, in the stem glass structural body STE, the tip-off portion thereof is mechanically protected by a CRT socket STS, which is made of an insulating resin material having an electrode terminal (not shown in the drawing) which is connected with an external power source.

Further, to one conductive lead COL1, which is embedded in the stem glass structural body STE, a lead line LEA is connected with a distal end portion of the conductive lead COL1, being connected to the lead line LEA by welding or the like, as shown in FIG. 3; while, the other end portion of the lead line LEA is electrically connected with one end portion of the anode ADE, which is formed on the inner surface of the face substrate SUB2 using a conductive adhesive agent or the like. Further, to the conductive lead COL2, for example, a getter GET is mounted and fixed by welding or the like. Here, another end portion of the conductive lead COL1 may be electrically connected with a portion of the black matrix film BM in place of the anode ADE, although this is not shown in the drawing.

Further, the spacers SPC shown in FIG. 2 are made of a thin glass plate and are mounted in a state such that the spacers SPC traverse the control electrode elements MRG, which constitute the control electrode MG. Further, the face panel PN2, which has the anode ADE and the phosphors PHS on an inner surface of the face substrate SUB2, is laminated to the back panel PN1 by interposing the sealing frame MFL.

Figure 4:
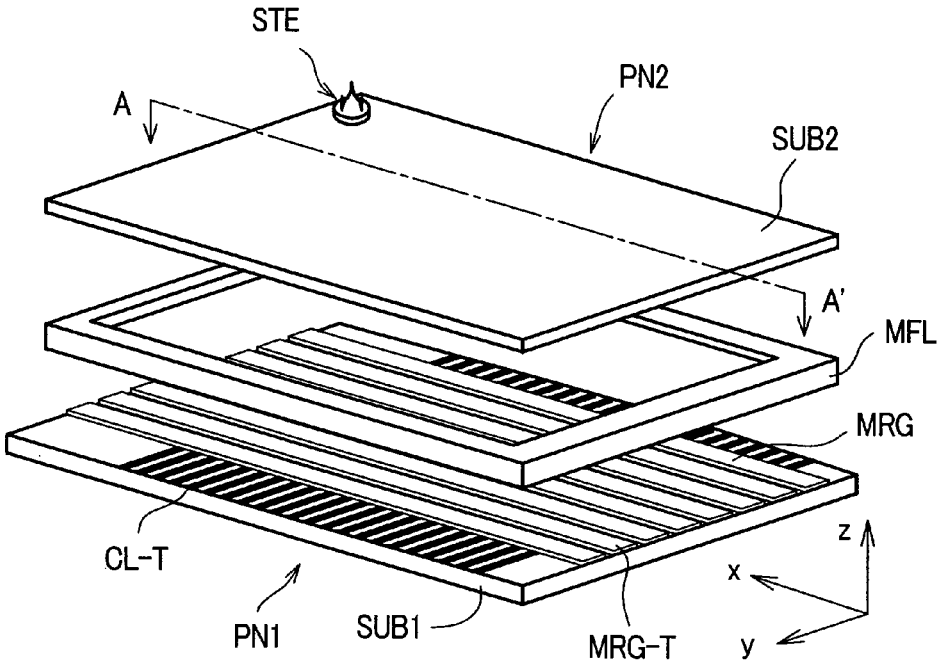
FIG. 4(*a*) is a developed perspective view and FIG. 4(*b*) is a sectional view taken along line A-A' in FIG. 4(*a*) showing a state in which a face panel is laminated to a back panel on which cathode lines and control electrodes are arranged by way of a sealing frame.
Figure 4:
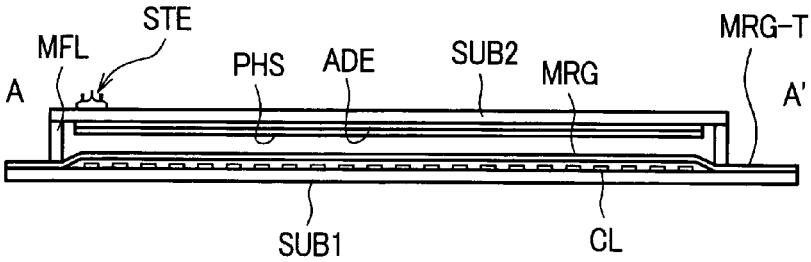

FIG. 4(*a*) and FIG. 4(*b*) shown the back panel on which the cathode lines, the control electrode elements and the like are formed. FIG. 4(*a*) shows the positional relationship among the back panel PN1, the sealing frame MFL and the face panel PN2. FIG. 4(*b*) shows a state in which the back panel PN1, the sealing frame MFL and the face panel PN2 are laminated to each other. In FIG. 4(*a*) and FIG. 4(*b*), the same symbols used in FIG. 1 and FIG. 2 are used to identify parts having identical functions. Here, symbol STE indicates a stem glass structural body in which the conductive leads COL1, COL2 are embedded and which has the exhaust pipe EXH at the center portion thereof. In the drawing, the illustration of the spacers SPC is omitted.

In the face panel PN2, first of all, the face substrate SUB2, which has the opening OPN1 formed therein, is prepared. After forming the phosphors PHS, the anode ADE and the like on the face substrate SUB2, the stem glass structural body STE is hermetically joined to the opening OPN1 with curing by heating, as described above. Further, the lead line LEA, which is connected with the distal end portion of the conductive lead COL1, is connected with one end portion of the anode ADE; and, further, the getter GET is fixed by welding to the other conductive lead COL2, thus preparing the face panel assembled body in advance.

To the back substrate SUB1, on which the cathode lines CL are formed, control electrode elements MRG which constitute the control electrode MG are fixed such that the control electrode elements MRG are insulated from the mentioned cathode lines CL. In FIG. 4(*a*) and FIG. 4(*b*), the control electrode elements MRG are pressed by the sealing frame MFL, and the control electrode elements MRG are fixed to the back substrate SUB1 simultaneously with the fixing of the back substrate SUB1 and the sealing frame MFL. Here, the leg portions LEG of the control electrode elements MRG shown in FIG. 1 are also fixed to the back substrate SUB1. The fixing of the control electrode elements MRG and the sealing frame MFL to the back substrate SUB1 is performed simultaneously with the fixing of the spacers SPC. That is, the face substrate SUB1, on which the cathode lines CL are formed, and a contact surface of the sealing frame MFL are fixed to each other by means of frit glass.

Figure 5:
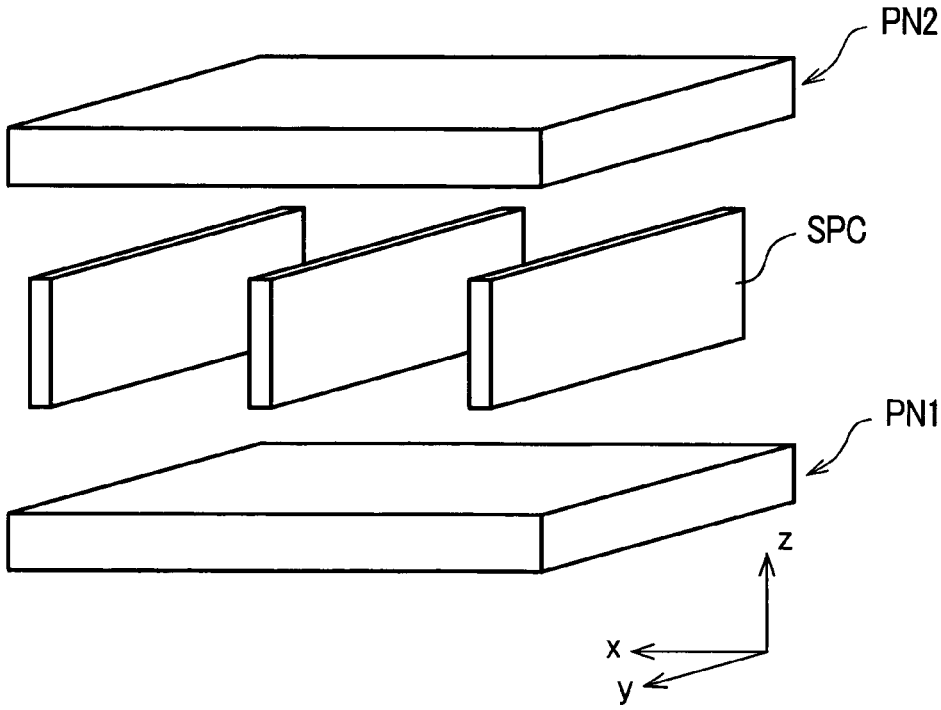
FIG. 5 is a diagram showing the arrangement of spacers interposed between the face panel and the back panel of the image display device according to the present invention.

FIG. 5 shows the arrangement of the spacers SPC, which are interposed between the back panel PN1 and the face panel PN2. In FIG. 5, the spacers SPC, which constitute the inner structural body, are arranged to bridge the back panel PN1 and the face panel PN2 to which the stem glass structural body STE is fixed. As mentioned previously, the spacers SPC are preferably made of a thin plate-like glass plate. One side of the spacers SPC is fixed to the back panel PN1 side, while the other side of the spacers SPC is fixed to the face panel PN2 side. For this purpose, a liquid-like adhesive agent containing multifunctional silane, for example, is applied to the sides of the spacers SPC, and the adhesive agent is cured by heating to fix the sides of the spacers SPC. Accordingly, it is possible to ensure that the spaces will be fixed with high accuracy to the back panel PN1, as well as to the face panel PN2.

In such a constitution, by forming the opening OPN1 in the corner portion of the face substrate SUB2, outside the display region, and by fixing the stem glass structural body STE, having the conductive lead COL1 and the conductive lead COL2 in the opening OPN1, by hermetic joining, it is possible to supply a high voltage to the anode ADE from the outside via the conductive lead COL1 and the lead line LEA. Accordingly, it is no longer necessary to form a conductive connection such as an anode button having a complicated structure; and, hence, it is possible to supply a high voltage to the anode ADE using a simple constitution.

Further, in such a constitution, since a large distance can be ensured between the conductive lead COL1 and the conductive lead COL2, it is possible to obtain a good dielectric strength property between the conductive leads. Accordingly, when supplying a high voltage via the conductive lead COL1, it is possible to obtain a sufficient dielectric strength property up to approximately 10 kV.

Further, in such a structure, by forming the getter GET on the distal end portion of the conductive lead COL2, it is possible to obtain the function of a getter to maintain the required degree of vacuum. Accordingly, it is unnecessary to reform a portion of the face substrate SUB2 or the back substrate SUB1 or to newly mount the getter member, and, hence, the getter function can be obtained with a simple structure. Further, since the exhaust pipe EXH is integrally mounted on the stem glass structural body STE, it is unnecessary to reform a portion of the face substrate SUB2 or the back substrate SUB1 and to newly mount the exhaust pipe, and, hence, the structure of the vacuum envelope can be simplified.

Here, in connection with the above-mentioned embodiment, although an explanation has been given with respect to a case in which two conductive leads COL1, COL2 are formed in the stem glass structural body STE, the present invention is not limited to such a case. That is, the present invention may be applicable to a case in which only one conductive lead COL1, which supplies a high voltage to the anode ADE, is formed, or a case in which, for example, a common terminal, such as a ground terminal of various electrodes which are formed in the inside in place of the getter GET, is fixed to the conductive lead COL2 by way of a lead line.

Embodiment 2

Figure 6:
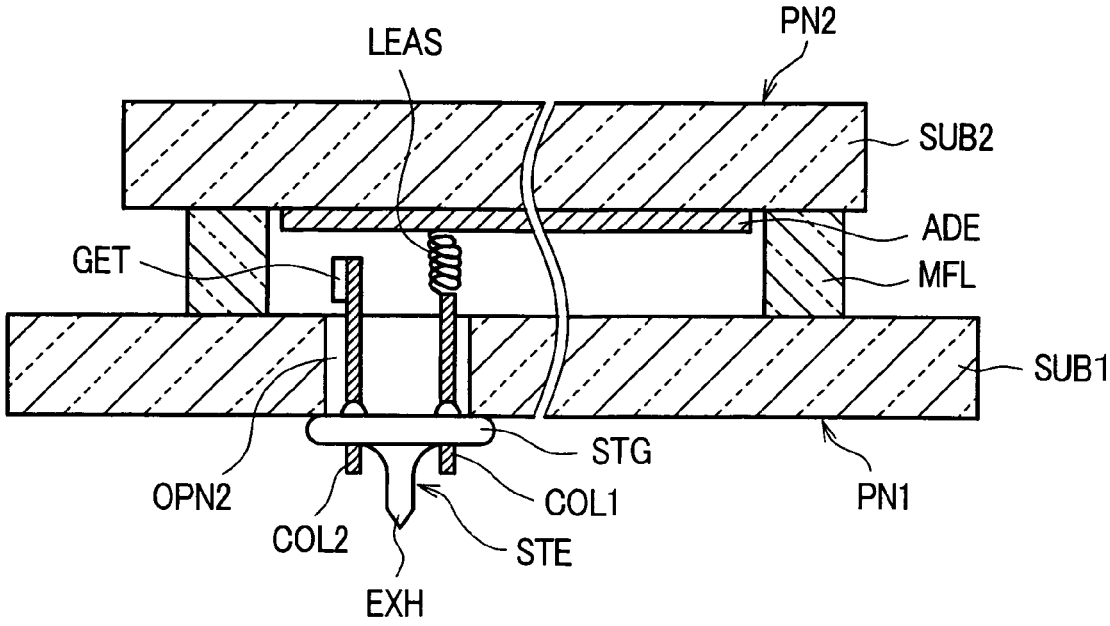
FIG. 6 is an enlarged cross-sectional view showing the constitution of an embodiment 2 of the image display device according to the present invention.

FIG. 6 shows an embodiment 2 of an image display device according to the present invention, wherein parts identical with the parts shown in FIG. 3 are identified by the same symbols. Further, the cathode lines CL, the control electrode elements MRG and the like, which are formed on the back substrate SUB1, are omitted from the drawing. The constitution which makes this embodiment different from the embodiment shown in FIG. 3 lies in the fact that, in a corner portion of the back substrate SUB1, which constitutes the back panel PN1, outside of the display region, an opening OPN2 is formed, wherein a stem glass structural body STE having the same constitution as the stem glass structural body STE in FIG. 3 is hermetically joined to the opening OPN2 by welding with curing by heating. Here, in the stem glass structural body STE, a tip-off portion thereof is mechanically protected by a CRT socket made of an insulating resin material having an electrode terminal which is connected with an external power source. However, in connection with this embodiment, illustration of the CRT socket is omitted in the drawings.

In such a constitution, one conductive lead COL1 has a distal end portion to which a lead line LEAS, made of a conductive spring material, is connected by welding, while the other end portion of the lead line LEAS is electrically connected with one end portion of an anode ADE, which is formed on an inner surface of a face substrate SUB2 in such a way that the other end portion of the lead line LEAS is mechanically brought into contact with one end portion of the anode ADE. Further, to another conductive lead COL2, for example, a getter GET is mounted and fixed by welding or the like. Here, in this case as well, the other end portion of the conductive lead COL1 may be electrically connected with a portion of a black matrix film in place of the anode ADE, although this is not shown in the drawing.

Further, in such a constitution, by fixing the front panel PN2 and the back panel PN1 with spacers and a sealing frame MFL (not shown in the drawing) disposed therebetween; and, thereafter, by hermetically joining the stem glass structural body STE to the opening OPN2, which is preliminarily formed in the back substrate SUB1, the electrical connection of an anode lead can be established. Further, a back panel assembled body may be preliminarily prepared by hermetically joining the stem glass structural body STE to the opening OPN2 that is formed in the back substrate SUB1, and, thereafter, the face panel PN2 and the back panel PN1 may be simultaneously formed by interposing the sealing frame MFL therebetween.

According to such a constitution, it is possible to supply a high voltage to the anode ADE from the outside via the conductive lead COL1 and the spring-like lead line LEA; and, hence, it is no longer necessary to form a conductive connection, such as an anode button structure having a complicated structure, whereby it is possible to supply a high voltage to a anode ADE with the simple constitution. Further, since it is possible to ensure the desired dielectric strength property between the conductive leads, it is possible to obtain a sufficient dielectric strength property of up to approximately 10 kV.

Embodiment 3

Figure 7:
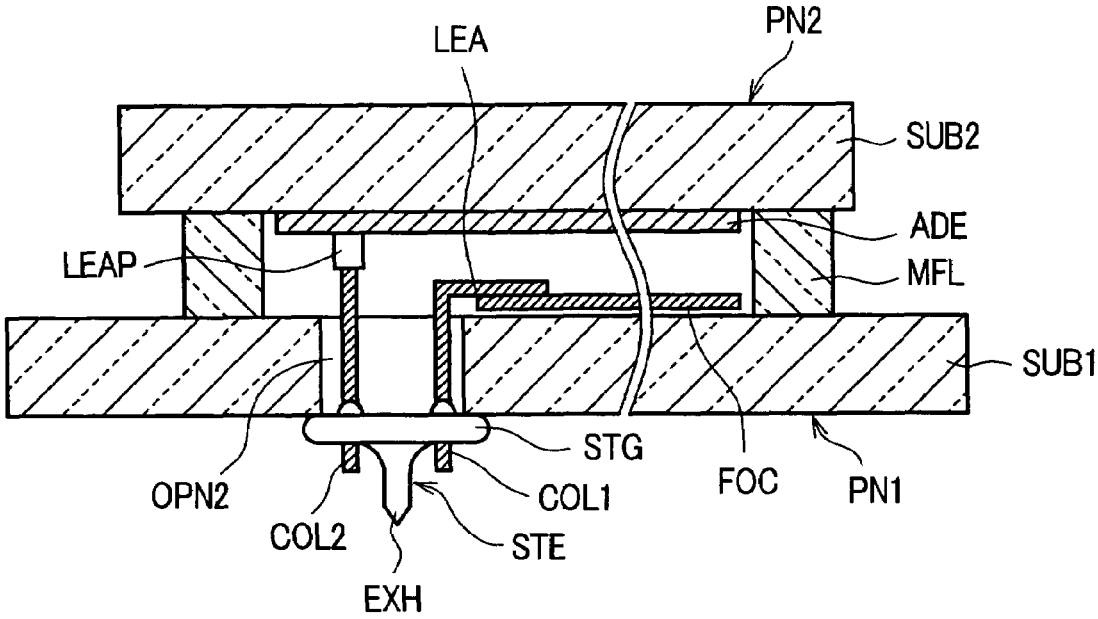
FIG. 7 is an enlarged cross-sectional view showing the constitution of an embodiment 3 of the image display device according to the present invention.

FIG. 7 shows an embodiment 3 of the image display device according to the present invention, wherein parts identical with the parts shown in FIG. 3 are identified by the same symbols. Also, in connection with this embodiment, illustration of the cathode lines CL, the control electrode elements MRG and the like, which are formed on the back substrate SUB1, is omitted from the drawing. The constitution which makes this embodiment shown in FIG. 7 different from the embodiment shown in FIG. 3 lies in the fact that, in a corner portion of the back substrate SUB1, which constitutes the back panel PN1, outside the display region, an opening OPN2 is formed, wherein a stem glass structural body STE, having the same constitution as the stem glass structural body STE in FIG. 3, is hermetically joined to the opening OPN2 by welding with curing by heating. Here, in the stem glass structural body STE, the tip-off portion is mechanically protected, by a CRT socket made of an insulating resin material having an electrode terminal which is connected with an external power source. However, in connection with this embodiment, illustration of the CRT socket is omitted in the drawing.

Further, one conductive lead COL1, which is embedded in the stem glass structural body STE, has a distal end portion to which a lead line LEA is connected by welding or the like, while the other end portion of the lead line LEA is electrically connected with one end portion of a focusing electrode FOC.

The focusing electrode FOC is arranged in an opposed manner between an anode AD and a control electrode terminal (not shown in the drawing), and it is mounted on the back substrate SUB1 and has electron passing holes. Further, to a distal end portion of the other conductive lead COL2, a conductive lead line LEAP, which is made of a conductive thin plate material having resiliency, is connected by welding or the like. The other end portion of the lead line LEAP is electrically connected with an one end portion of the anode ADE that is formed on an inner surface of the face substrate SUB2 such that the lead line LEAP is mechanically brought into contact with the anode ADE due to its resiliency.

Here, the mounting of the stem glass structural body STE is performed such that the stem glass structural body STE is hermetically joined to the opening OPN2 of the back substrate SUB1 before fixing the back panel PN1 to the sealing frame MFL. The lead line LEA of the conductive lead COL1 and one end portion of the focusing electrode FOC, which is mounted on the back substrate SUB1, are connected with each other; and, thereafter, the back panel PN1 and the face panel PN2 are fixed to each other while interposing the sealing frame MFL. Accordingly, the conductive lead COL2 is connected with the anode ADE due to the contact attributed to the resiliency of the lead line LEAP.

According to such a constitution, it is possible to supply a high voltage to the anode ADE from the outside via the conductive lead COL2 and the plate-like lead line LEAP; and, hence, it is no longer necessary to form a conductive connection, such as an anode button having a complicated structure, whereby it is possible to supply a high voltage to the anode ADE with a simple constitution. Further, in addition to the supply of a high voltage to the anode ADE, it is also possible to supply the focusing voltage to the focusing electrode FOC simultaneously; and, hence, it is unnecessary to newly form an electrode terminal for supplying a focusing voltage on the back substrate SUB1, whereby the constitution of the back panel PN1 can be simplified. Further, in such a constitution, it is possible to ensure the desired dielectric strength property between the conductive leads, and, hence, it is possible to obtain a sufficient dielectric strength property of up to approximately 10 kV.

Here, in the above-mentioned embodiment, although an explanation has been given with respect to a case in which the conductive lead COL1 is connected with one end portion of the focusing electrode FOC, it may be possible to mount a surge current absorbing electrode (not shown in the drawing) on the back substrate SUB1 such that the surge current absorbing electrode faces the anode ADE in an opposed manner and the conductive lead COL1 is connected with one end portion of the surge current absorbing electrode via a lead line, thus employing the conductive lead COL1 as a surge current absorbing lead which is connected with a spark gap. Due to such a constitution, it is possible to realize both the desired dielectric resistance property and a surge current absorbing function simultaneously.

Embodiment 4

Figure 8:
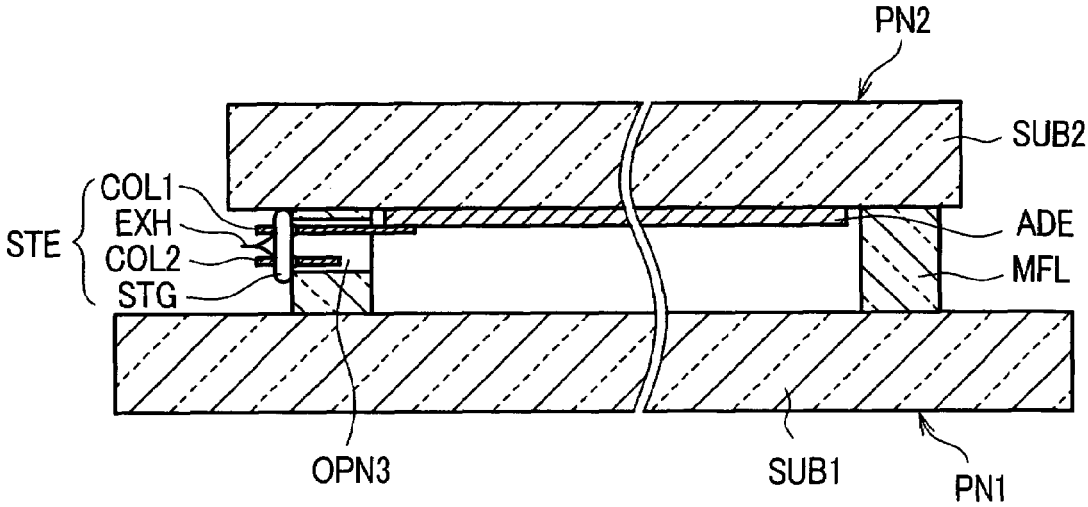
FIG. 8 is an enlarged cross-sectional view showing the constitution of a embodiment 4 of the image display device according to the present invention.
Figure 9:
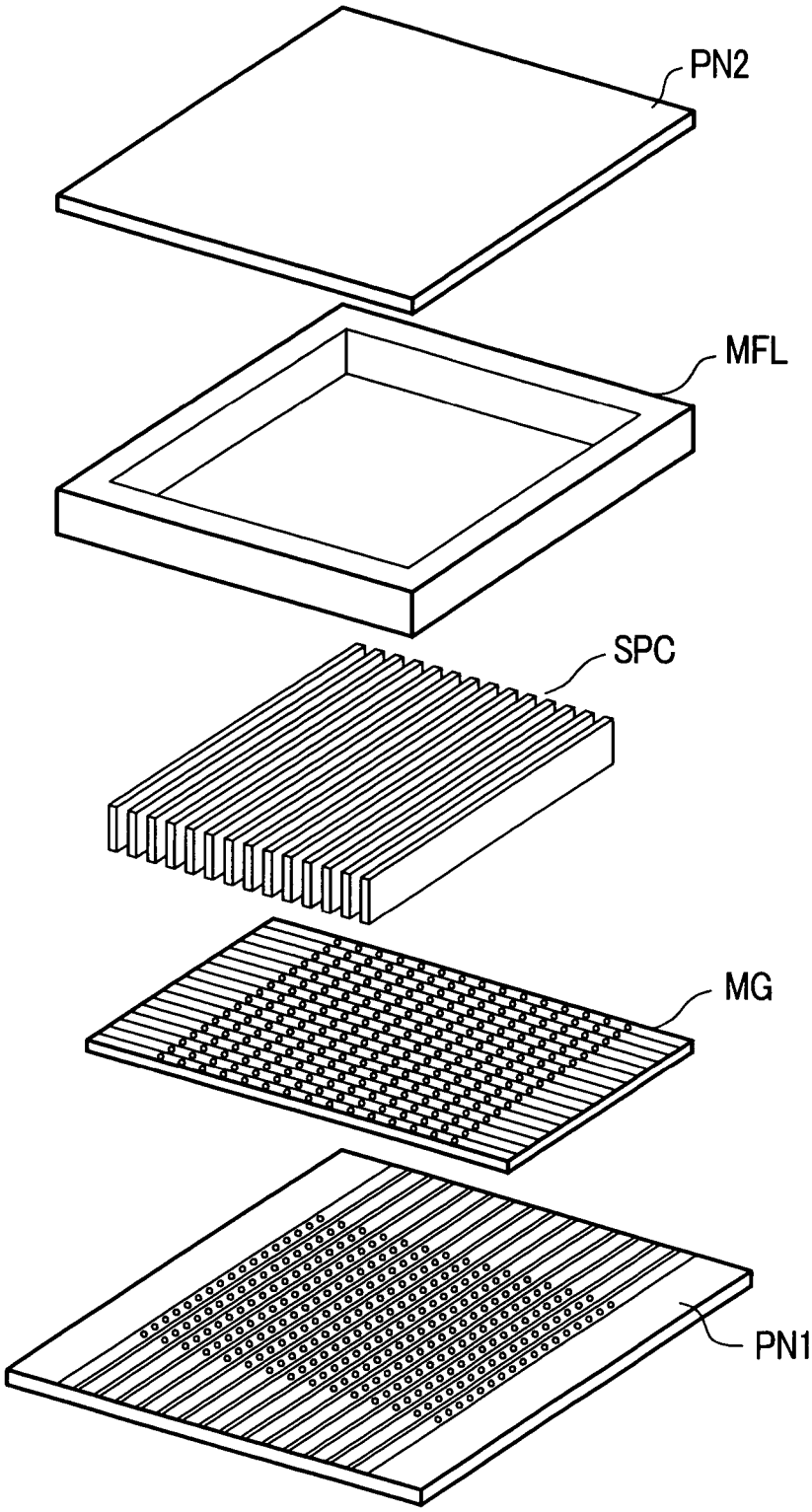
FIG. 9 is a developed perspective view showing the constitution of a conventional field emission type display device.
Figure 10:
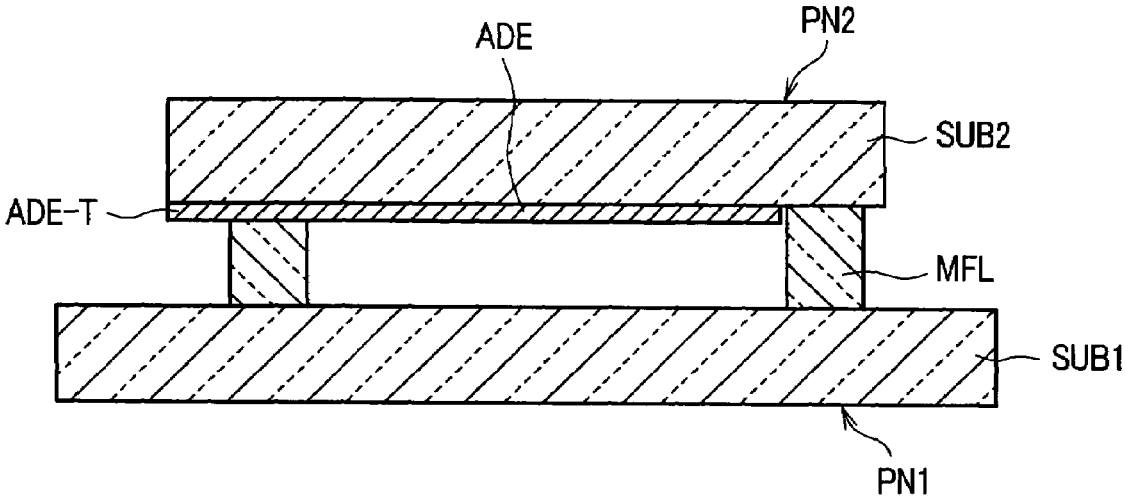
FIG. 10(*a*) is a section view and FIG. 10(*b*) is a plan view are views showing the high voltage supply means used to supply a high voltage to an anode of a conventional field emission type display device.
Figure 10:
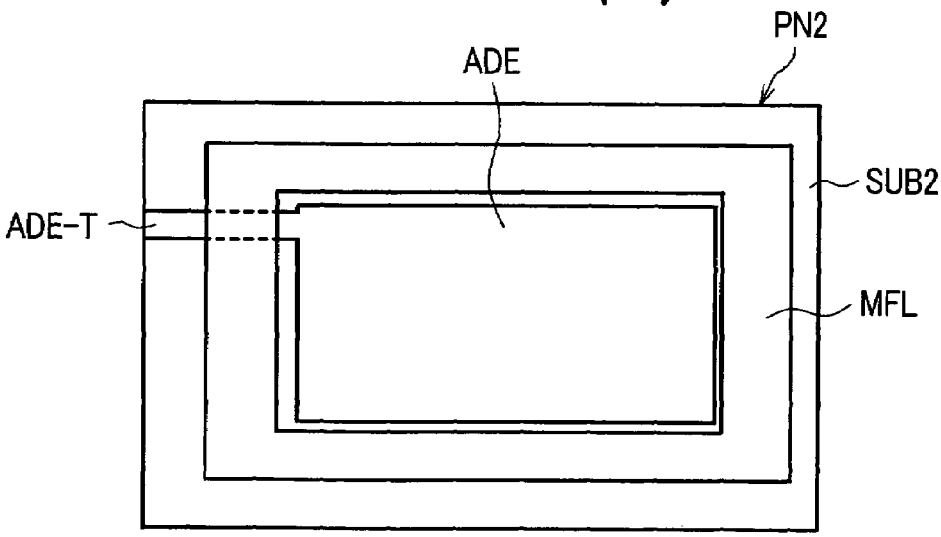

FIG. 8 shows an embodiment 4 of the image display device according to the present invention, wherein parts identical with the parts shown in FIG. 3 are identified by the same symbols. Also, in this embodiment, the cathode lines CL, the control electrode elements MRG and the like, which are formed on the back substrate SUB1, are omitted in the drawing. The constitution which makes this embodiment shown in FIG. 8 different from the embodiment shown in FIG. 3 lies in the fact that an opening OPN3 is formed in a portion of a sealing frame MFL, wherein a stem glass structural body STE, having the same constitution as the stem glass structural body STE in FIG. 3, is hermetically joined to the opening OPN3 by welding with curing by heating. Here, in the stem glass structural body STE, the tip-off portion thereof is mechanically protected by a CRT socket made of an insulating resin material having an electrode terminal, which is connected with an external power source. However, in connection with this embodiment, illustration of the CRT socket is omitted in the drawing.

Further, one conductive lead COL1, which is embedded in the stem glass structural body STE, has a distal end portion thereof electrically connected to one end portion of the anode ADE using a conductive adhesive material. Further, it is possible to selectively connect, for example, either one of a common terminal for grounding the above-mentioned getter, the focusing electrode, the surge current absorbing electrode or various electrodes and lead lines, or a common terminal for grounding of various electrodes which are arranged on the back substrate SUB, with a distal end portion of another conductive lead COL2. Here, in this case, the electrical connection is established using a conductive adhesive agent such that the back substrate SUB1, the sealing frame MFL and the face substrate SUB2 are connected by being temporarily adhered to each other.

According to such a constitution, it is possible to reduce the number of lead electrode terminals to the outside of various electrodes formed on the back substrate SUB1, in addition to the above-mentioned advantageous effects of the other respective embodiments.

Further, according to such a constitution, by mounting the stem glass structural body STE on the sealing body MFL, it is possible to prevent the stem glass structural body STE from projecting from the surface of the face panel PN2 or the back panel PN1. Accordingly, when display panels are arranged in a stacked manner or packaged in multiple stages as finished products, an external mechanical pressure is hardly applied to the stem glass structural bodies, and, hence, it is possible to easily protect the stem glass structural bodies per se, whereby the handling of the stem glass structural bodies is facilitated.

Here, with respect to the above-mentioned respective embodiments, an explanation has been given for a case in which an outer peripheral shape of the stem glass STG of the stem glass structural body STE is illustrated as a circular shape. However, the present invention is not limited to such a shape, and the stem glass STG may be formed in any suitable shape, including an elliptical shape, a rectangular shape and a triangular shape.

Further, with respect to the above-mentioned embodiments, an explanation has been given for a case in which two conductive leads are mounted on the stem glass structural body STE. However, the present invention is not limited to such a constitution, and a plurality of conductive leads may be mounted on the stem glass structural body STE when necessary. In this case, the mounting position of the stem glass structural body STE is arranged outside the display region in the face panel PN2 and outside the respective electrode forming regions in the back panel PN2, and it has a thickness of approximately several mm in the sealing frame MFL. Hence, the number of leads may be four to six at a maximum.

Further, with respect to the above-mentioned embodiments, an explanation has been given for a case in which the stem glass structural body STE is mounted on any one of the face panel PN2, the back panel PN1 and the sealing frame MFL. However, the present invention is not limited to such a case, and the stem glass structural body STE may be mounted on a plurality of these constitutional parts depending on the number of lead lines of the respective electrodes which are arranged in the inside of the constitutional parts. Further, although an explanation has been given for a case in which the stem glass structural body STE is mounted at one place on any one of these constitutional parts, the present invention is not limited to such a case, and the stem glass structural body STE may be mounted at a plurality of places outside the image display region.

Further, with respect to the above-mentioned embodiments, an explanation has been given for a case in which the present invention is applied to a field emission panel serving as the image display device. However, the present invention is not limited to such an application, and it is possible to obtain advantageous effects that are substantially the same as the above-mentioned advantageous effects even when the present invention is applied to other types of display device using a flat panel.

What is claimed is:

1. An image display device comprising:

a face substrate having an anode and phosphors on an inner surface thereof;

a back substrate which has electron sources on an inner surface thereof and is arranged to face the face substrate with a given distance therebetween; and a sealing frame which is interposed between the face substrate and the back substrate while surrounding a display region and which holds the face substrate and the back substrate at the given distance;

wherein end surfaces of the sealing frame and the face substrate and the back substrate are respectively hermetically sealed by way of a sealing material thus forming a vacuum envelope;

wherein said vacuum envelope has an exhausting portion with an exhausting pipe formed in a stem glass;

wherein an outer electrical lead hermetically penetrates into said stem glass of said exhausting portion at a position spaced from said exhausting pipe so as to electrically contact said anode; and wherein said anode is disposed on the inner surface of said face substrate without extending to an end of said face substrate.

2. An image display device according to claim 1, wherein said anode is spaced from said sealing frame.

3. An image display device according to claim 1, wherein a getter is provided in a region of said exhausting portion.

4. An image display device according to claim 3, wherein said getter is electrically separated from said outer lead.

5. An image display device according to claim 1, wherein said exhausting portion is formed of said stem glass.

* * * * *